United States Patent [19]

Kupersmit

[11] Patent Number: 4,892,210

[45] Date of Patent: Jan. 9, 1990

[54] CONTAINER CARGO NET

[76] Inventor: Julius B. Kupersmit, 299 West 12th St., New York, N.Y. 10014

[21] Appl. No.: 258,625

[22] Filed: Oct. 17, 1988

[51] Int. Cl.[4] ..... B65D 88/16

[52] U.S. Cl. ..... 220/1.5; 87/12; 220/400; 294/77

[58] Field of Search ..... 87/12, 13; 220/1.5, 220/400–403; 294/68.1, 68.21, 68.3, 77

[56] References Cited

U.S. PATENT DOCUMENTS

| | | | |
|---|---|---|---|
| 1,365,511 | 1/1921 | Lee | 294/77 |
| 2,854,931 | 10/1958 | Campbell | 294/77 |
| 3,084,966 | 4/1963 | Higgins | 294/77 |
| 3,173,539 | 3/1965 | Looker | 294/77 |
| 4,159,840 | 7/1979 | Fengels | 294/77 |

*Primary Examiner*—Jimmy G. Foster

*Attorney, Agent, or Firm*—Charles E. Temko

[57] ABSTRACT

A container cargo net for use with a shipping container of palletized or other type for the purpose of preventing shifting of the container when the net is interconnected to one or more fixed anchors on the inner surface of a vehicle in which the container is positioned. The net is particularly suited for use with containers having at least one movable door in a side wall thereof, permitting access to the interior of the container. The net includes a selectively closable T-shaped opening in that portion of the net overlying the door, which opening is closed by the use of color-coded hooks ot overlie the door in closed condition. Disengagement of the hooks permits access to the door as required, without the necessity of disconnecting a major portion of the net and folding it over the roof of the container.

4 Claims, 1 Drawing Sheet

CONTAINER CARGO NET

BACKGROUND OF THE INVENTION

This invention relates generally to the field of cargo containers, and more particularly to an improved cargo net adapted to be permanently attached to a cargo container for the purpose of providing anchoring means for the container during shipment in a vehicle, particularly an aircraft cargo hold. The net normally completely surrounds the container, and is provided with hook means attachable to corresponding anchor points on a wall of the cargo hold. As a result, should the vehicle execute an unusual maneuver, the container is able to remain in its original loaded position.

Certain cargo containers, for example, that are disclosed in my copending application, Ser. No. 07/205,234, filed June 10, 1988, are provided with hingedly mounted doors which swing outwardly when loading or unloading the container. With a conventional net, it is necessary to disconnect a substantial portion of the net from the container in order to gain access to the door. Normally, a complete side leg of the net must be disconnected and folded over the top of the container. This operation is cumbersome, both in the initial removal of the leg and its replacement.

SUMMARY OF THE INVENTION

Briefly stated, the invention contemplates the provision of an improved cargo net of the class described in which the above-mentioned disadvantages have been substantially eliminated. To this end, the disclosed net is provided with a T-shaped opening on one leg thereof, selectively opened by the disengagement of hooks in an area overlying the door of the container to provide access therethrough. The net can thus be swung to the side, after opening, rather than over the top of the container, without difficulty on the part of the user. To assist in rapid reclosure of the T-shaped openings, preferably including hook means along certain edges of the opening are color-coded, to enable a user to immediately determine which hook engages a particular knot.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
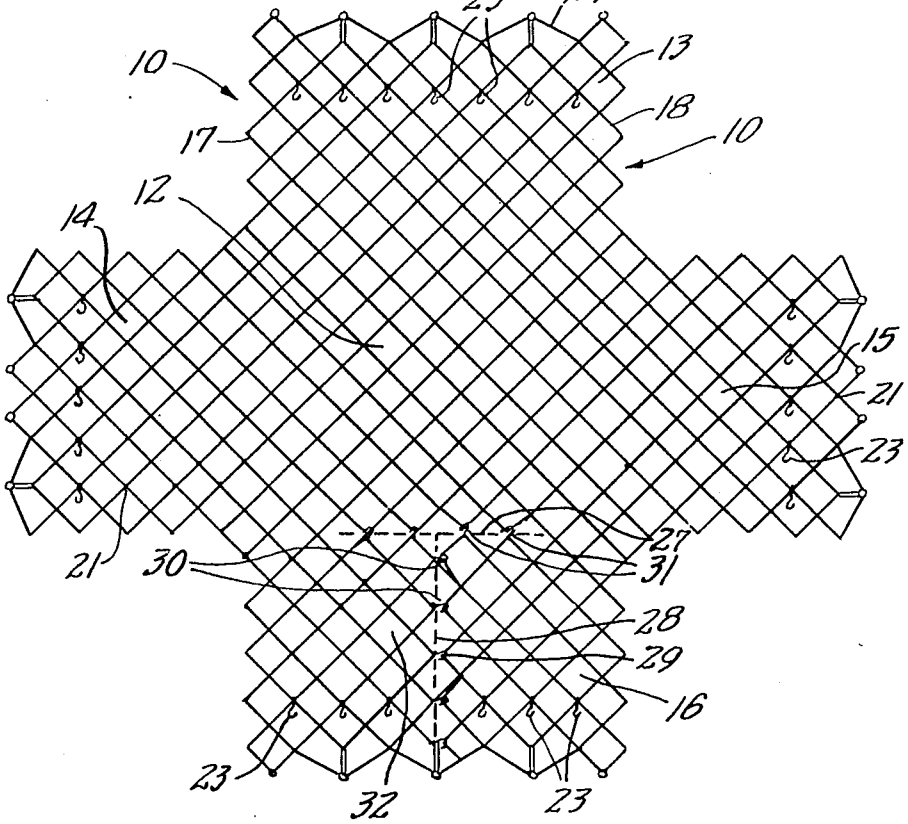
FIG. 1 is a developed view of a cargo net embodying the invention.

In accordance with the invention, the device, generally indicated by reference character 10, is of cruciform shape, as best seen in FIG. 1 in the drawing, and includes a central portion 12, as well as first, second, third and fourth leg portions 13, 14, 15, and 16, respectively. Each of the leg portions is bounded by first and second side edges 17 and 18, and an end edge 19. The net is of generally conventional construction, in which a plurality of elongated strands of rope-like material 20 are interconnected by knots 21 to form a rectangular pattern.

Each of the end edges 19 is provided with known hook members 23 for engaging the edge of a pallet 24, slip sheet or other floor structure of the container 25 which it encloses.

Figure 4:
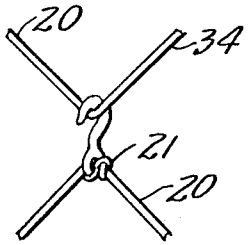
FIG. 4 is a fragmentary view showing the interconnection of a single hook means with single knot during the selective opening of the net.

Referring to FIG. 1, first and second dashed lines 27 and 28 extend through points of disconnection 29 of a generally T-shaped opening. Along these lines are a first set of vertically arranged hooks 30 and a second set of transversely arranged hooks 31, the disconnection of which permits the exposure of a generally rectangular area 32 through which access to the container 25 is possible. Interconnection is made by abutting first and second knots 34 and 35 (see FIG. 4), both of which are preferably color coded so that corresponding engageable portions can be readily identified by a user.

Figure 2:
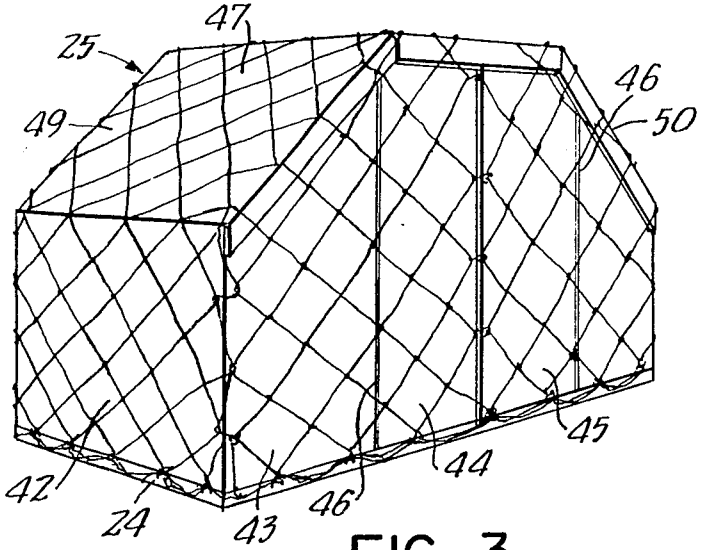
FIG. 2 is a view in perspective of a cargo container with the embodiment in engaged condition thereon.
Figure 3:
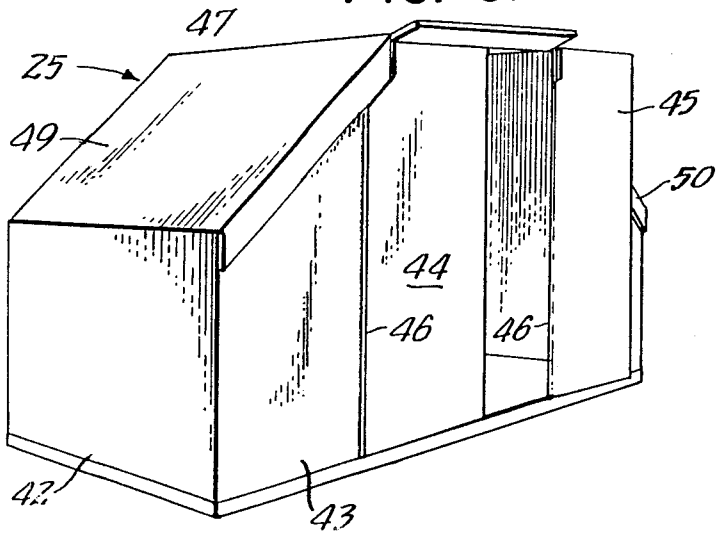
FIG. 3 is a similar view in perspective, showing the net in open condition, with a hingedly mounted door of the container opened therebeneath.

Referring to FIGS. 2 and 3, the device 10 is illustrated in an engaged condition upon a cargo container 25 of the type disclosed in my above-mentioned copending application. This type of container is preferably collapsible when not in use, and is supported by a wood pallet 24 or corresponding slip sheet (not shown). It includes a pair of end walls 42, a pair of side walls 43, a pair of abutting doors 44 and 45, each having a hinged interconnection at 46. A roof 47 includes a top wall 48 and first and second sloping walls 49 and 50.

To gain access to either or both of the doors 44–45, it is necessary only to disengage the hooks which maintain the T-shaped opening in closed condition and swing the thereby formed separate parts of the rectangular area 32 in opposite directions, thereby exposing the doors 44–45. Once the container 40 has been loaded and the doors 44–45 closed, the hook means is again employed to close the T-shaped opening, following which the device 10 functions in normal manner.

It may be observed that in the absence of a T-shaped opening, as is the case with normal cargo net construction, it is necessary to completely disengage one of the legs of the net at the lower edge thereof, and throw the disengaged leg over the roof of the container, which, in the case of a relatively large container, involves considerable effort on the part of the user. When the net is to be returned to original condition, it is necessary to pull this leg over the roof and drop it down again over the doors of the container. Returning the net to its original condition often involves even greater difficulty, since the detached leg must be dragged over the surface of the central portion thereof before allowing it to fall in vertical orientation for subsequent attachment. In the case of very large containers, often more than one person is required to accomplish this result.

I wish it to be understood that I do not consider the invention limited to the precise details of structure shown and set forth in this specification, for obvious modifications will occur to those skilled in the art to which the invention pertains.

I claim:

1. In an improved cargo net for use in enclosing an individual, generally rectangular cargo container to permit anchoring of the container with respect to a vehicle hold in which the container is positioned, said net being of generally cruciform shape, including a centrally disposed portion, and four leg portions, said leg portions having end edges and means for engaging corresponding lower edges of a container, the improvement comprising: one of said leg portions having a T-shaped opening therein with abutting vertical edges extending to a corresponding end edge; and plural hook means for selectively closing said T-shaped opening, whereby to permit selective access to said container without the necessity of folding said leg portion over the roof of said container.

2. The improvement set forth in claim 1, further characterized in each of said plural hook means being color coded to correspond to a specific knotted area on an opposing edge of said T-shaped opening to facilitate identification of the particular knot to which a given hook is selectively attached.

3. In combination, a generally rectangularly shaped cargo container and a cargo net attached to and surrounding said container to provide anchor points for maintaining said container in relatively fixed position within a cargo hold, said cargo container having at least one vertical wall having a movable door therein for accessing the interior of said container; said cargo net being of generally cruciform shape including a centrally disposed portion and four leg portions, said leg portions having end edges secured to said container at a lower peripheral edge thereof; one of said leg portions having a generally T-shaped opening with abutted vertical edges extending to a corresponding end edge of said leg portion, said opening overlying said door; and plural hook means on first edges of said T-shaped opening for selectively engaging portions of corresponding second edges of said opening to maintain said opening in closed condition.

4. The combination set forth in claim 3, further characterized in said plural hook means being color coded, said corresponding second edges including color-coded knots to facilitate identification of the particular knot to which a given hook means is selectively attached.

* * * * *